US010714014B2

(12) United States Patent
Yan et al.

(10) Patent No.: US 10,714,014 B2
(45) Date of Patent: Jul. 14, 2020

(54) OLED PIXEL DRIVING CIRCUIT AND OLED DISPLAY

(71) Applicant: Wuhan China Star Optoelectronics Semiconductor Display Technology Co., Ltd., Wuhan (CN)

(72) Inventors: Weinan Yan, Wuhan (CN); Jun Li, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 3 days.

(21) Appl. No.: 16/326,226

(22) PCT Filed: Nov. 1, 2018

(86) PCT No.: PCT/CN2018/113303

§ 371 (c)(1),
(2) Date: Feb. 18, 2019

(87) PCT Pub. No.: WO2019/242200

PCT Pub. Date: Dec. 26, 2019

(65) Prior Publication Data

US 2020/0135107 A1 Apr. 30, 2020

(30) Foreign Application Priority Data

Jun. 21, 2018 (CN) ..... 2018 1 0644432

(51) Int. Cl.
*G09G 3/3258* (2016.01)
*G09G 3/20* (2006.01)

(52) U.S. Cl.
CPC ..... *G09G 3/3258* (2013.01); *G09G 3/2007* (2013.01); *G09G 2310/0256* (2013.01); *G09G 2320/0257* (2013.01)

(58) Field of Classification Search
CPC ..... G09G 3/3258; G09G 3/2007; G09G 2310/0256; G09G 2320/0257
See application file for complete search history.

(56) References Cited

U.S. PATENT DOCUMENTS

2006/0125737 A1 6/2006 Kwak et al.
2008/0252217 A1 10/2008 Kim
2015/0116191 A1* 4/2015 Qi ..... G09G 3/3233 345/76

(Continued)

FOREIGN PATENT DOCUMENTS

CN 1779767 5/2006
CN 101286297 10/2008

(Continued)

*Primary Examiner* — Sahlu Okebato

(57) ABSTRACT

An organic light emitting diode (OLED) pixel driving circuit and an OLED display are provided. The OLED pixel driving circuit includes a first thin-film transistor (TFT), a second TFT, a third TFT, a fourth TFT, a fifth TFT, a sixth TFT, a capacitor, a first OLED, and a second OLED. A drain of the third TFT is connected to an anode of the first OLED, a cathode of the second OLED, and a source of the sixth TFT. A drain of the fifth TFT is connected to a cathode of the first OLED, an anode of the second OLED, and a source of the fourth TFT. A drain of the sixth TFT and a drain of the fourth TFT both receiving a power supply negative voltage.

20 Claims, 4 Drawing Sheets

(56) References Cited

U.S. PATENT DOCUMENTS

| | | | | |
|---|---|---|---|---|
| 2018/0122304 | A1 | 5/2018 | Kim et al. | |
| 2018/0226019 | A1* | 8/2018 | Tong | G09G 3/3233 |
| 2018/0301093 | A1 | 10/2018 | Li et al. | |

FOREIGN PATENT DOCUMENTS

| | | |
|---|---|---|
| CN | 103000132 | 3/2013 |
| CN | 203325414 | 12/2013 |
| CN | 103927973 | 7/2014 |
| CN | 205194299 | 4/2016 |
| CN | 105895028 | 8/2016 |
| CN | 106847179 | 6/2017 |
| CN | 107731163 | 2/2018 |
| CN | 107945741 | 4/2018 |

* cited by examiner

OLED PIXEL DRIVING CIRCUIT AND OLED DISPLAY

RELATED APPLICATIONS

This application is a National Phase of PCT Patent Application No. PCT/CN2018/113303 having International filing data of Nov. 1, 2018, which claims the benefit of priority of Chinese Patent Application No. 201810644432.4 filed on Jun. 21, 2018. The contents of the above applications are all incorporated by reference as if fully set forth herein in their entirety.

FIELD AND BACKGROUND OF THE INVENTION

The present disclosure relates to the field of display technology, and more particularly, to an organic light emitting diode (OLED) pixel driving circuit and an OLED display.

An active-matrix organic light emitting diode (AMOLED) is one kind of display technology for televisions and mobile devices. Compared with the mainstream liquid crystal displays (LCDs) of the related art, the AMOLED displays have advantages of high contrast, wide viewing angle, low power consumption, and compact size so the AMOLED is one of the most popular flat panel display technologies.

However, the brightness of the OLEDs display of the related art keeps the same very long, resulting in the shift of the light-emitting characteristics. In addition, the efficiency of light emitting is lowered so afterimages occur easily and the display effect is lowered.

To solve the problem of the related art, it is necessary to propose a new OLED pixel driving circuit and an OLED display adopting the OLED pixel driving circuit.

SUMMARY OF THE INVENTION

An object of the present disclosure is to propose a solution, that is, to provide an organic light emitting diode (OLED) pixel driving circuit and an OLED display. Afterimages are eliminated and the displaying effect is improved in the present disclosure.

According to a first aspect of the present disclosure, an organic light emitting diode (OLED) pixel driving circuit includes:

a first thin-film transistor (TFT), a second TFT, a third TFT, a fourth TFT, a fifth TFT, a sixth TFT, a capacitor, a first OLED, and a second OLED;

a gate of the first TFT receiving a scanning signal; a source of the first TFT receiving a data signal; a drain of the first TFT connected to a gate of the second TFT and one terminal of the capacitor;

a source of the second TFT and the other terminal of the capacitor both receiving a power supply positive voltage; a drain of the second TFT connected to a source of the third TFT and a source of the fifth TFT;

a gate of the third TFT, a gate of the fourth TFT, a gate of the fifth TFT, and a gate of the sixth TFT all receiving a controlling signal; a drain of the third TFT connected to an anode of the first OLED, a cathode of the second OLED, and a source of the sixth TFT;

a drain of the fifth TFT connected to a cathode of the first OLED, an anode of the second OLED, and a source of the fourth TFT;

a drain of the sixth TFT and a drain of the fourth TFT both receiving a power supply negative voltage;

wherein the first TFT, the second TFT, the third TFT, and the fourth TFT are all N-type TFTs; the fifth TFT and the sixth TFT are both P-type TFTs; when a current frame of image is displayed, the controlling signal is at a high voltage level; when a following frame of image is displayed, the controlling signal is at a low voltage level.

According to an embodiment of the present disclosure, the OLED pixel driving circuit further comprises a seventh TFT and an eighth TFT; the controlling signal comprises a first controlling signal and a second controlling signal; the data signal comprises a first data signal and a second data signal;

a gate of the seventh TFT receives the first controlling signal; a source of the seventh TFT receives the first data signal;

a gate of the eighth TFT receives a second controlling signal; a source of the eighth TFT receives a second data signal; the source of the first TFT is connected to a drain of the seventh TFT and a drain of the eighth TFT;

the gate of the third TFT and the gate of the fourth TFT both receive the first controlling signal;

the gate of the fifth TFT and the gate of the sixth TFT T6 both receive the second controlling signal.

According to an embodiment of the present disclosure, the seventh TFT and the eighth TFT are both N-type TFTs.

According to an embodiment of the present disclosure, when the current frame of image is displayed, the first controlling signal is at a high voltage level and the second controlling signal is at a low voltage level; when the following frame of image is displayed, the second controlling signal is at a high voltage level and the first controlling signal is at a low voltage level.

According to an embodiment of the present disclosure, the first controlling signal and the second controlling signal are both signals with a square wave; the period of the first controlling signal is the same as the period of the second controlling signal; the polarity of the first controlling signal is opposite to the polarity of the second controlling signal.

According to an embodiment of the present disclosure, the first data signal and the second data signal are set according to the brightness of the first OLED and the brightness of the second OLED at the same grayscale level; the brightness of the first OLED is the same as the brightness of the second OLED at the same grayscale level.

According to an embodiment of the present disclosure, the first TFT, the second TFT, the third TFT, the fourth TFT, the fifth TFT, and the sixth TFT all are low temperature polysilicon TFTs, oxide semiconductor TFTs, or amorphous silicon (a-Si) TFTs arbitrarily.

According to a second aspect of the present disclosure, an organic light emitting diode (OLED) pixel driving circuit comprises:

a first thin-film transistor (TFT), a second TFT, a third TFT, a fourth TFT, a fifth TFT, a sixth TFT, a capacitor, a first OLED, and a second OLED;

a gate of the first TFT receiving a scanning signal; a source of the first TFT receiving a data signal; a drain of the first TFT connected to a gate of the second TFT and one terminal of the capacitor;

a source of the second TFT and the other terminal of the capacitor both receiving a power supply positive voltage; a drain of the second TFT connected to a source of the third TFT and a source of the fifth TFT;

a gate of the third TFT, a gate of the fourth TFT, a gate of the fifth TFT, and a gate of the sixth TFT all receiving a controlling signal; a drain of the third TFT connected to an anode of the first OLED, a cathode of the second OLED, and a source of the sixth TFT;

a drain of the fifth TFT connected to a cathode of the first OLED, an anode of the second OLED, and a source of the fourth TFT;

a drain of the sixth TFT and a drain of the fourth TFT both receiving a power supply negative voltage.

According to an embodiment of the present disclosure, the first TFT, the second TFT, the third TFT, and the fourth TFT are all N-type TFTs; the fifth TFT and the sixth TFT are both P-type TFTs.

According to an embodiment of the present disclosure, when a current frame of image is displayed, the controlling signal is at a high voltage level; when a following frame of image is displayed, the controlling signal is at a low voltage level.

According to an embodiment of the present disclosure, the OLED pixel driving circuit further comprises a seventh TFT and an eighth TFT; the controlling signal comprises a first controlling signal and a second controlling signal; the data signal comprises a first data signal and a second data signal;

a gate of the seventh TFT receives the first controlling signal; a source of the seventh TFT receives the first data signal;

a gate of the eighth TFT receives a second controlling signal; a source of the eighth TFT receives a second data signal; the source of the first TFT is connected to a drain of the seventh TFT and a drain of the eighth TFT;

the gate of the third TFT and the gate of the fourth TFT both receive the first controlling signal;

the gate of the fifth TFT and the gate of the sixth TFT T6 both receive the second controlling signal.

According to an embodiment of the present disclosure, the seventh TFT and the eighth TFT are both N-type TFTs.

According to an embodiment of the present disclosure, when the current frame of image is displayed, the first controlling signal is at a high voltage level and the second controlling signal is at a low voltage level; when the following frame of image is displayed, the second controlling signal is at a high voltage level and the first controlling signal is at a low voltage level.

According to an embodiment of the present disclosure, the first controlling signal and the second controlling signal are both signals with a square wave; the period of the first controlling signal is the same as the period of the second controlling signal; the polarity of the first controlling signal is opposite to the polarity of the second controlling signal.

According to an embodiment of the present disclosure, the first data signal and the second data signal are set according to the brightness of the first OLED and the brightness of the second OLED at the same grayscale level; the brightness of the first OLED is the same as the brightness of the second OLED at the same grayscale level.

According to an embodiment of the present disclosure, the first TFT, the second TFT, the third TFT, the fourth TFT, the fifth TFT, and the sixth TFT all are low temperature polysilicon TFTs, oxide semiconductor TFTs, or amorphous silicon (a-Si) TFTs arbitrarily.

According to a third aspect of the present disclosure, an organic light emitting diode (OLED) display includes an OLED pixel driving circuit as disclosed above.

The OLED pixel driving circuit and the OLED display of the present disclosure prevent the OLED from being in a light-emitting state very long and avoid the shift of the light-emitting characteristics of the OLED by means of reversing bias frame-by-frame, thereby eliminating the afterimage phenomenon and improving the display effect of the panel.

DESCRIPTION OF SPECIFIC EMBODIMENTS OF THE INVENTION

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

The structure of an organic light emitting diode (OLED) pixel driving circuit of the related art is usually 2T1C, that is, the structure of two thin-film transistors (TFTs) and a capacitor. The OLED pixel driving circuit of the related art converts voltage into the current.

Figure 1:
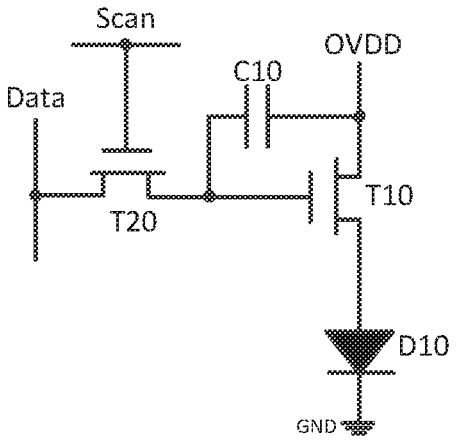
FIG. 1 (PRIOR ART)
FIG. 1 illustrates an organic light emitting diode (OLED) pixel driving circuit of the related art.

As illustrated in FIG. 1, the OLED pixel driving circuit with the 2T1C structure of the related art includes a first TFT T10, a second TFT T20, a capacitor C10, and an OLED D10. The first TFT T10 is a driving TFT. The second TFT T20 is a switching TFT. The capacitor C10 is a storage capacitor. A gate of the second TFT T20 receives a scanning signal Scan. A source of the second TFT T20 receives a data signal Data. A drain of the second TFT T20 is electrically connected to a gate of the first TFT T10. A source of the first TFT T10 receives a power supply positive voltage OVDD. A drain of the first TFT T10 is electrically connected to an anode of the OLED D10. A cathode of the OLED D10 is grounded. One terminal of the capacitor C10 is electrically connected to the gate of the first TFT T10. The other terminal of the capacitor C10 is electrically connected to the source of the first TFT T10.

When the 2T1C pixel driving circuit drives the OLED, the current flowing through the OLED D10 satisfies a formula as follows:

$$I=k\times(Vgs-Vth)^2;$$

In this formula, I represents the current flowing through the OLED D10; k represents an intrinsic conductive factor of the driving TFT; Vgs represents the difference between voltage imposed on the gate of the first TFT T10 and voltage imposed on the source of the first TFT T10; Vth represents the threshold voltage imposed on the first TFT T10.

Figure 2:
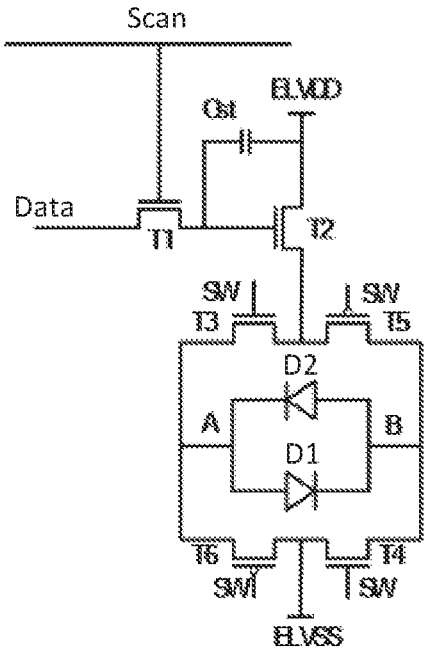
FIG. 2 illustrates a circuit diagram of the OLED pixel driving circuit according to an embodiment of the present disclosure.

Please refer to FIG. 2 to FIG. 9. FIG. 2 illustrates a schematic diagram of the OLED pixel driving circuit according to an embodiment of the present disclosure.

As illustrated in FIG. 2, the OLED pixel driving circuit of the present disclosure includes a first TFT T1, a second TFT T2, a third TFT T3, a fourth TFT T4, a fifth TFT T5, a sixth TFT T6, a capacitor Cst, a first OLED D1, and a second OLED D2. The first TFT T1 is a driving TFT. The OLED pixel driving circuit inputs a scanning signal Scan, a data signal Data, and a controlling signal SW.

Specifically, these components are connected in the following manner: A gate of the first TFT T1 receives the scanning signal Scan. A source of the first TFT T1 receives the data signal Data. A drain of the first TFT T1 is connected to a gate of the second TFT T2 and one terminal of the capacitor Cst.

A source of the second TFT T2 and the other terminal of the capacitor Cst both receive a power supply positive voltage ELVDD. A drain of the second TFT T2 is connected to a source of the third TFT T3 and a source of the fifth TFT T5.

A gate of the third TFT T3, a gate of the fourth TFT T4, a gate of the fifth TFT T5, and a gate of the sixth TFT T6 all receive a controlling signal SW. A drain of the third TFT T3 is connected to an anode of the first OLED D1, a cathode of the second OLED D2, and a source of the sixth TFT T6.

A drain of the fifth TFT T5 is connected to a cathode of the first OLED D1, an anode of the second OLED D2, and a source of the fourth TFT T4;

A drain of the sixth TFT T6 and a drain of the fourth TFT T4 both receive a power supply negative voltage ELVSS.

The first TFT T1, the second TFT T2, the third TFT T3, and the fourth TFT T4 are all N-type TFTs. The fifth TFT T5 and the sixth TFT T6 are both P-type TFTs.

The first TFT T1, the second TFT T2, the third TFT T3, the fourth TFT T4, the fifth TFT T5, and the sixth TFT T6 all are low temperature polysilicon TFTs, oxide semiconductor TFTs, or amorphous silicon (a-Si) TFTs arbitrarily.

Figure 3:
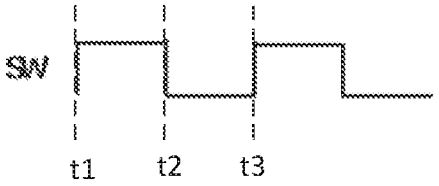
FIG. 3 illustrates a waveform of a controlling signal applied in the OLED pixel driving circuit according to an embodiment of the present disclosure.

As illustrated in FIG. 3, the controlling signal SW is a signal with a square wave. When a current frame of image (that is, the t1-t2 period) is displayed, the controlling signal SW is at a high voltage level. When a following frame of image is displayed (that is, a t2-t3 period), the controlling signal SW is at a low voltage level. The remaining frames are similar to this condition.

Figure 4:
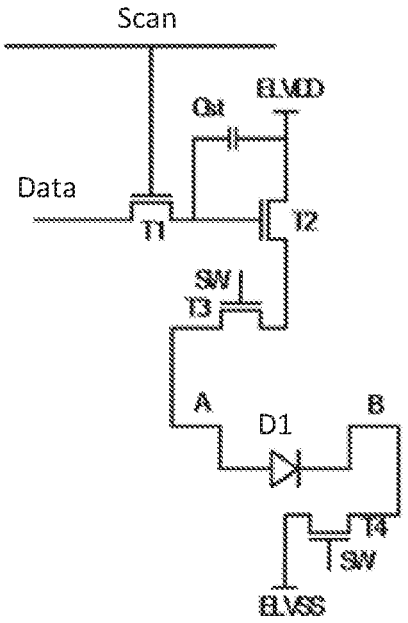
FIG. 4 illustrates an equivalent circuit of the OLED pixel driving circuit depicted in FIG. 2 when displaying a current frame.

As illustrated in FIG. 4, when a first frame of image is displayed and the controlling signal SW is at a high voltage level, the third TFT T3 and the fourth TFT T4 are both turned on and the fifth TFT T5 and the sixth TFT T6 are both turned off. At this time, the voltage on node A is greater than the voltage on node B, which drives the first OLED D1 to emit light. In addition, the second OLED D2 is in a reverse bias state.

Figure 5:
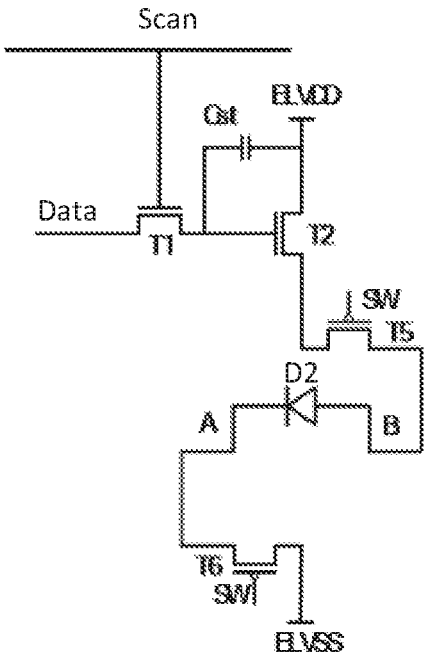
FIG. 5 illustrates an equivalent circuit of the OLED pixel driving circuit depicted in FIG. 2 when displaying a next frame.

As illustrated in FIG. 5, when a second frame of image is displayed and the controlling signal SW is at a low voltage level, the fifth TFT T5 and the sixth TFT T6 are both turned on and the third TFT T3 and the fourth TFT T4 are both turned off. At this time, the voltage on node B is greater than the voltage on node A, which drives the second OLED D2 to emit light. Moreover, the first OLED D1 is in a reverse bias state.

Therefore, the OLED in the present disclosure avoids keeping emitting light long by means of a frame-by-frame reverse bias and prevents the shift of the light-emitting characteristics of the OLED, effectively prevents the generation of afterimages, and further prolongs the service life of the OLED.

Figure 6:
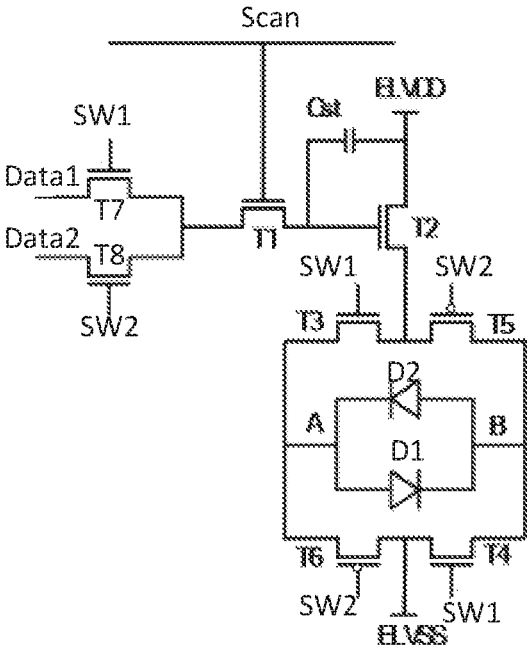
FIG. 6 illustrates a circuit diagram of the OLED pixel driving circuit according to another embodiment of the present disclosure.

In order to solve the problem that the luminous efficiencies of the first OLED D1 and the second OLED D2 are inconsistent due to the process differences, that is, the brightness of two adjacent frames flickers inconsistently. As illustrated in FIG. 6, the OLED pixel driving circuit proposed by the present embodiment further includes a seventh TFT T7 and an eighth TFT T8. The controlling signal includes a first controlling signal SW1 and a second controlling signal SW2. The data signal includes a first data signal Data1 and a second data signal Data2. The OLED pixel driving circuit inputs the first data signal Data1, the second data signal Data2, the first controlling signal SW1, and the second controlling signal SW2.

A gate of the seventh TFT T7 receives the first controlling signal SW1. A source of the seventh TFT T7 receives the first data signal Data1.

A gate of the eighth TFT T8 receives the second controlling signal SW2. A source of the eighth TFT T8 receives the second data signal Data2. The source of the first TFT T1 is connected to a drain of the seventh TFT T7 and a drain of the eighth TFT T8.

The gate of the third TFT T3 and the gate of the fourth TFT T4 both receive the first controlling signal SW1. The gate of the fifth TFT T5 and the gate of the sixth TFT T6 both receive the second controlling signal SW2.

The seventh TFT T7 and the eighth TFT T8 are both N-type TFTs.

Figure 7:
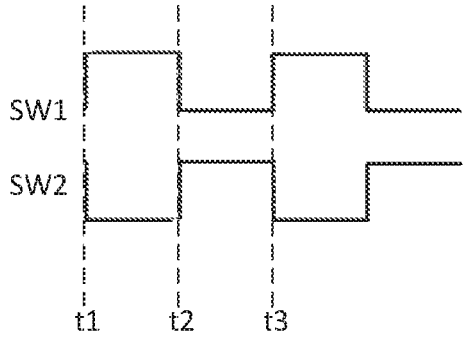
FIG. 7 illustrates a waveform of a controlling signal applied in the OLED pixel driving circuit depicted in FIG. 6.

As illustrated in FIG. 7, the first controlling signal SW1 and the second controlling signal SW2 are both signals with a square wave. Moreover, the period of the first controlling signal SW1 is the same as the period of the second controlling signal SW2. However, the polarity of the first controlling signal SW1 is opposite to the polarity of the second controlling signal SW2.

Figure 8:
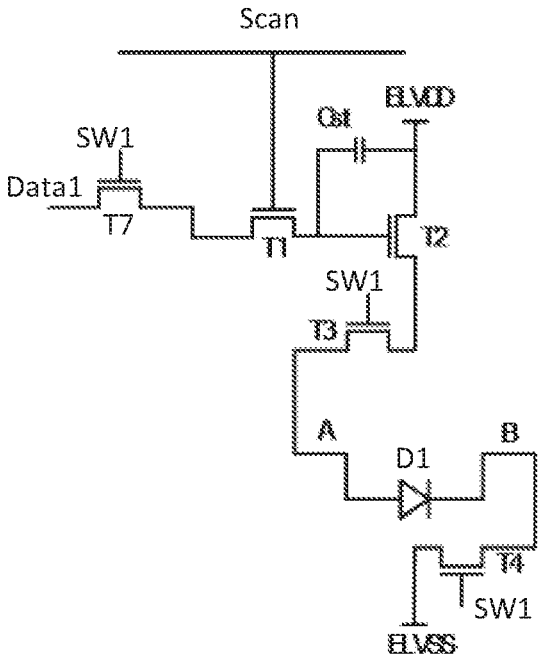
FIG. 8 illustrates an equivalent circuit of the OLED pixel driving circuit depicted in FIG. 6 when displaying a current frame.

As illustrated in FIG. 8, when the current frame of image (for example, the first frame of image, that is, the t1-t2 period) is displayed, the first controlling signal SW1 is at a high voltage level and the second controlling signal SW2 is at a low voltage level. Besides, the third TFT T3 and the fourth TFT T4 are both turned on, and the fifth TFT T5 and the sixth TFT T6 are both turned off. At this time, the voltage on node A is greater than the voltage on node B, which drives the first OLED D1 to emit light. Moreover, the second OLED D2 is in a reverse bias state.

Figure 9:
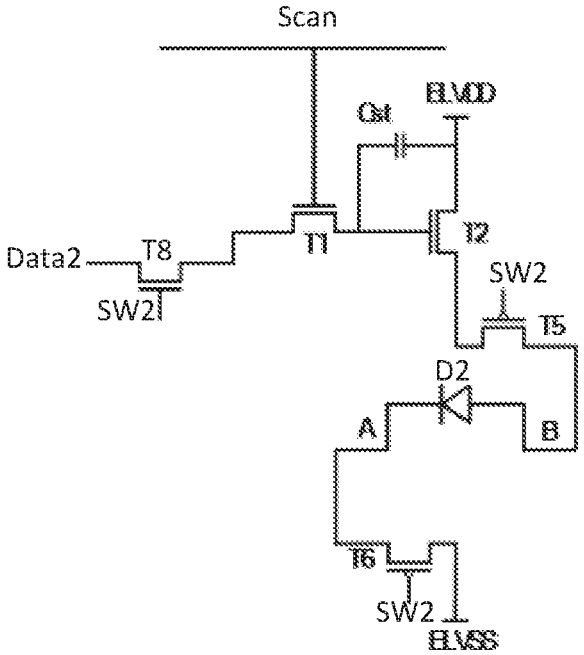
FIG. 9 illustrates an equivalent circuit of the OLED pixel driving circuit depicted in FIG. 6 when displaying a next frame.

As illustrated in FIG. 9, when the following frame of image (that is, the t2-t3 period) is displayed, the second controlling signal SW2 is at a high voltage level and the first controlling signal SW1 is at a low voltage level. Besides, the fifth TFT T5 and the sixth TFT T6 are both turned on, and the third TFT T3 and the fourth TFT T4 are both turned off. At this time, the voltage on node B is greater than the voltage on node A, which drives the second OLED D2 to emit light. Moreover, the first OLED D1 is in a reverse bias state.

The size of the first data signal Data1 and the size of the second data signal Data2 are set according to the brightness of the first OLED D1 and the second OLED D2 at the same grayscale level. The brightness of the first OLED D1 is the same as the brightness of the second OLED D2 at the same grayscale level.

That is to say, the brightness of the first OLED D1 and the brightness of the second OLED D2 at the same grayscale level are the same by adjusting the size of the first data signal Data1 and the size of the second data signal Data2.

For example, when the brightness of the first OLED D1 under the testing grayscale is greater than the brightness of the second OLED D2, the first data signal is turned down so that the brightness of the first OLED D1 can be equal to the brightness of the second OLED D2 at the same grayscale level. While the brightness of the first OLED D1 under the testing grayscale is less than the brightness of the second OLED D2, the second data signal is turned down so that the brightness of the first OLED D1 can be equal to the brightness of the second OLED D2 at the same grayscale level.

The present disclosure further provides an organic light emitting diode (OLED) display including the OLED pixel driving circuit, which has been detailed in the embodiment.

The OLED pixel driving circuit and the OLED display of the present disclosure prevent the OLED from being in a light-emitting state very long and avoid the shift of the light-emitting characteristics of the OLED by means of reversing bias frame-by-frame, thereby eliminating the afterimage phenomenon and improving the display effect of the panel.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. An organic light emitting diode (OLED) pixel driving circuit, comprising:

a first thin-film transistor (TFT), a second TFT, a third TFT, a fourth TFT, a fifth TFT, a sixth TFT, a capacitor, a first OLED, and a second OLED;

a gate of the first TFT receiving a scanning signal; a source of the first TFT receiving a data signal; a drain of the first TFT connected to a gate of the second TFT and one terminal of the capacitor;

a source of the second TFT and the other terminal of the capacitor both receiving a power supply positive voltage; a drain of the second TFT connected to a source of the third TFT and a source of the fifth TFT;

a gate of the third TFT, a gate of the fourth TFT, a gate of the fifth TFT, and a gate of the sixth TFT all receiving a controlling signal; a drain of the third TFT connected to an anode of the first OLED, a cathode of the second OLED, and a source of the sixth TFT;

a drain of the fifth TFT connected to a cathode of the first OLED, an anode of the second OLED, and a source of the fourth TFT;

a drain of the sixth TFT and a drain of the fourth TFT both receiving a power supply negative voltage;

wherein the first TFT, the second TFT, the third TFT, and the fourth TFT are all N-type TFTs; the fifth TFT and the sixth TFT are both P-type TFTs; when a current frame of image is displayed, the controlling signal is at a high voltage level; when a following frame of image is displayed, the controlling signal is at a low voltage level.

2. The OLED pixel driving circuit of claim 1, wherein the OLED pixel driving circuit further comprises a seventh TFT and an eighth TFT; the controlling signal comprises a first controlling signal and a second controlling signal; the data signal comprises a first data signal and a second data signal;

a gate of the seventh TFT receives the first controlling signal; a source of the seventh TFT receives the first data signal;

a gate of the eighth TFT receives a second controlling signal; a source of the eighth TFT receives a second data signal; the source of the first TFT is connected to a drain of the seventh TFT and a drain of the eighth TFT;

the gate of the third TFT and the gate of the fourth TFT both receive the first controlling signal;

the gate of the fifth TFT and the gate of the sixth TFT T6 both receive the second controlling signal.

3. The OLED pixel driving circuit of claim 2, wherein the seventh TFT and the eighth TFT are both N-type TFTs.

4. The OLED pixel driving circuit of claim 2, wherein when the current frame of image is displayed, the first controlling signal is at a high voltage level and the second controlling signal is at a low voltage level; when the following frame of image is displayed, the second controlling signal is at a high voltage level and the first controlling signal is at a low voltage level.

5. The OLED pixel driving circuit of claim 2, wherein the first controlling signal and the second controlling signal are both signals with a square wave; the period of the first controlling signal is the same as the period of the second controlling signal; the polarity of the first controlling signal is opposite to the polarity of the second controlling signal.

6. The OLED pixel driving circuit of claim 2, wherein the first data signal and the second data signal are set according to the brightness of the first OLED and the brightness of the second OLED at the same grayscale level; the brightness of the first OLED is the same as the brightness of the second OLED at the same grayscale level.

7. The OLED pixel driving circuit of claim 1, wherein the first TFT, the second TFT, the third TFT, the fourth TFT, the fifth TFT, and the sixth TFT all are low temperature polysilicon TFTs, oxide semiconductor TFTs, or amorphous silicon (a-Si) TFTs arbitrarily.

8. An organic light emitting diode (OLED) pixel driving circuit, comprising:

a first thin-film transistor (TFT), a second TFT, a third TFT, a fourth TFT, a fifth TFT, a sixth TFT, a capacitor, a first OLED, and a second OLED;

a gate of the first TFT receiving a scanning signal; a source of the first TFT receiving a data signal; a drain of the first TFT connected to a gate of the second TFT and one terminal of the capacitor;

a source of the second TFT and the other terminal of the capacitor both receiving a power supply positive voltage; a drain of the second TFT connected to a source of the third TFT and a source of the fifth TFT;

a gate of the third TFT, a gate of the fourth TFT, a gate of the fifth TFT, and a gate of the sixth TFT all receiving a controlling signal; a drain of the third TFT connected to an anode of the first OLED, a cathode of the second OLED, and a source of the sixth TFT;

a drain of the fifth TFT connected to a cathode of the first OLED, an anode of the second OLED, and a source of the fourth TFT;

a drain of the sixth TFT and a drain of the fourth TFT both receiving a power supply negative voltage.

9. The OLED pixel driving circuit of claim 8, wherein the first TFT, the second TFT, the third TFT, and the fourth TFT are all N-type TFTs; the fifth TFT and the sixth TFT are both P-type TFTs.

10. The OLED pixel driving circuit of claim 8, wherein when a current frame of image is displayed, the controlling signal is at a high voltage level; when a following frame of image is displayed, the controlling signal is at a low voltage level.

11. The OLED pixel driving circuit of claim 8, wherein the OLED pixel driving circuit further comprises a seventh TFT and an eighth TFT; the controlling signal comprises a first controlling signal and a second controlling signal; the data signal comprises a first data signal and a second data signal;

a gate of the seventh TFT receives the first controlling signal; a source of the seventh TFT receives the first data signal;

a gate of the eighth TFT receives a second controlling signal; a source of the eighth TFT receives a second data signal; the source of the first TFT is connected to a drain of the seventh TFT and a drain of the eighth TFT;

the gate of the third TFT and the gate of the fourth TFT both receive the first controlling signal;

the gate of the fifth TFT and the gate of the sixth TFT T6 both receive the second controlling signal.

12. The OLED pixel driving circuit of claim 11, wherein the seventh TFT and the eighth TFT are both N-type TFTs.

13. The OLED pixel driving circuit of claim 11, wherein when the current frame of image is displayed, the first controlling signal is at a high voltage level and the second controlling signal is at a low voltage level; when the following frame of image is displayed, the second controlling signal is at a high voltage level and the first controlling signal is at a low voltage level.

14. The OLED pixel driving circuit of claim 13, wherein the first controlling signal and the second controlling signal are both signals with a square wave; the period of the first controlling signal is the same as the period of the second controlling signal; the polarity of the first controlling signal is opposite to the polarity of the second controlling signal.

15. The OLED pixel driving circuit of claim 11, wherein the first data signal and the second data signal are set according to the brightness of the first OLED and the brightness of the second OLED at the same grayscale level; the brightness of the first OLED is the same as the brightness of the second OLED at the same grayscale level.

16. The OLED pixel driving circuit of claim 8, wherein the first TFT, the second TFT, the third TFT, the fourth TFT, the fifth TFT, and the sixth TFT all are low temperature polysilicon TFTs, oxide semiconductor TFTs, or amorphous silicon (a-Si) TFTs arbitrarily.

17. An organic light emitting diode (OLED) display, comprising an OLED pixel driving circuit, the OLED pixel driving circuit comprising:

a first thin-film transistor (TFT), a second TFT, a third TFT, a fourth TFT, a fifth TFT, a sixth TFT, a capacitor, a first OLED, and a second OLED;

a gate of the first TFT receiving a scanning signal; a source of the first TFT receiving a data signal; a drain of the first TFT connected to a gate of the second TFT and one terminal of the capacitor;

a source of the second TFT and the other terminal of the capacitor both receiving a power supply positive voltage; a drain of the second TFT connected to a source of the third TFT and a source of the fifth TFT;

a gate of the third TFT, a gate of the fourth TFT, a gate of the fifth TFT, and a gate of the sixth TFT all receiving a controlling signal; a drain of the third TFT connected to an anode of the first OLED, a cathode of the second OLED, and a source of the sixth TFT;

a drain of the fifth TFT connected to a cathode of the first OLED, an anode of the second OLED, and a source of the fourth TFT;

a drain of the sixth TFT and a drain of the fourth TFT both receiving a power supply negative voltage.

18. The OLED display of claim 17, wherein the first TFT, the second TFT, the third TFT, and the fourth TFT are all N-type TFTs; the fifth TFT and the sixth TFT are both P-type TFTs.

19. The OLED display of claim 17, wherein when a current frame of image is displayed, the controlling signal is at a high voltage level; when a following frame of image is displayed, the controlling signal is at a low voltage level.

20. The OLED display of claim 17, wherein the OLED pixel driving circuit further comprises a seventh TFT and an eighth TFT; the controlling signal comprises a first controlling signal and a second controlling signal; the data signal comprises a first data signal and a second data signal;

a gate of the seventh TFT receives the first controlling signal; a source of the seventh TFT receives the first data signal;

a gate of the eighth TFT receives a second controlling signal; a source of the eighth TFT receives a second data signal; the source of the first TFT is connected to a drain of the seventh TFT and a drain of the eighth TFT;

the gate of the third TFT and the gate of the fourth TFT both receive the first controlling signal;

the gate of the fifth TFT and the gate of the sixth TFT T6 both receive the second controlling signal.

* * * * *